US009109305B2

(12) United States Patent
Choi et al.

(10) Patent No.: US 9,109,305 B2
(45) Date of Patent: Aug. 18, 2015

(54) PREPARATION METHOD FOR HOLLOW CARBON FIBER

(75) Inventors: Young-Ho Choi, Gyeonggi-do (KR); Do Suck Han, Gyeonggi-do (KR); Chi-Hoon Choi, Gyeonggi-do (KR)

(73) Assignee: Hyundai Motor Company, Seoul (KR)

( * ) Notice: Subject to any disclaimer, the term of this patent is extended or adjusted under 35 U.S.C. 154(b) by 659 days.

(21) Appl. No.: 13/396,324

(22) Filed: Feb. 14, 2012

(65) Prior Publication Data

US 2013/0136914 A1 May 30, 2013

(30) Foreign Application Priority Data

Nov. 30, 2011 (KR) ..... 10-2011-0126533

(51) Int. Cl.

| | |
|---|---|
| ***C01B 31/02*** | (2006.01) |
| ***D01D 5/12*** | (2006.01) |
| ***D01D 5/24*** | (2006.01) |
| ***D02J 1/22*** | (2006.01) |
| ***D01F 9/22*** | (2006.01) |

(52) U.S. Cl.
CPC *D01D 5/24* (2013.01); *D01F 9/225* (2013.01); *D02J 1/228* (2013.01)

(58) Field of Classification Search
CPC ..... C01B 31/02; D01D 5/12; D01D 5/24; D01F 9/225; D02J 1/228
USPC ..... 264/29.2, 29.6, 29.7, 177.14, 209.3, 264/209.4, 209.5, 210.7, 210.8; 423/447.1, 423/447.2, 447.7, 447.8
See application file for complete search history.

(56) References Cited

U.S. PATENT DOCUMENTS

| | | | | | |
|---|---|---|---|---|---|
| 2,578,899 | A | * | 12/1951 | Pace, Jr. | 264/210.7 X |
| 6,143,411 | A | * | 11/2000 | Ferguson | 428/398 |
| 6,641,792 | B2 | | 11/2003 | Takeda et al. | |

FOREIGN PATENT DOCUMENTS

| | | | | |
|---|---|---|---|---|
| GB | 843179 | A | * | 8/1960 |
| JP | 64026723 | A | * | 1/1989 |
| JP | 2008127697 | A | | 6/2008 |
| JP | 2008163537 | A | | 7/2008 |
| JP | 2008214562 | A | | 9/2008 |
| KR | 10-0180825 | | | 12/1998 |
| KR | 10-0270441 | | | 3/2000 |
| KR | 10-2011-0076349 | | | 7/2011 |

* cited by examiner

*Primary Examiner* — Leo B Tentoni
(74) *Attorney, Agent, or Firm* — Mintz Levin Cohn Ferris Glovsky and Popeo, P.C.; Peter F. Corless

(57) ABSTRACT

Disclosed is a method for preparing hollow carbon fibers having an empty space in the cross section thereof. More specifically, the disclosed method includes preparing a spinning solution of an acrylonitrile-based polymer having a viscosity ranging from 2000 to 5000 poise at room temperature; spinning the prepared spinning solution using a spinneret designed for spinning hollow fibers; super-drawing and drawing spun fibers to prepare hollow precursor fibers; and stabilizing and carbonizing the hollow precursor fibers to prepare the hollow carbon fibers. The hollow carbon fibers obtained by the disclosed method have a lower specific gravity by 10 to 50% than conventional hollow carbon fibers (solid), but have similar mechanical properties to the conventional fibers. Furthermore, in the method, the diameter of carbon fibers can be adjusted. Thus, it is possible to widen the application of hollow carbon fibers.

6 Claims, 1 Drawing Sheet

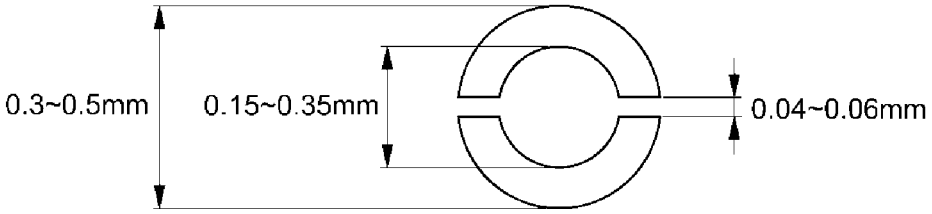
0.3~0.5mm
0.15~0.35mm
0.04~0.06mm

PREPARATION METHOD FOR HOLLOW CARBON FIBER

CROSS-REFERENCE TO RELATED APPLICATION

This application claims under 35 U.S.C. §119(a) the benefit of Korean Patent Application No. 10-2011-0126533 filed on Nov. 30, 2011, the entire contents of which are incorporated herein by reference.

BACKGROUND (a) Technical Field

The present invention relates to a method for preparing hollow carbon fibers having an empty space in the cross section thereof.

(b) Background Art

With a growing concern on the depletion of petroleum resources, and environmentally safe resources worldwide, there has been a continued interest in improving fuel efficiency in vehicles. As a result, research for reducing the weight of a vehicle has been conducted, and one most efficient ways to reduce the weight of a vehicle is through the application of carbon fiber composite parts. The carbon fiber in the carbon fiber composite, however, has a higher specific gravity than resin, its parent material. Thus, if the strength of a carbon fiber is maintained, while reducing the specific gravity of the carbon fiber, weight reduction can be better achieved.

In an effort to further reduce the weight of carbon fibers, hollow carbon fibers having an empty space in the cross section thereof has been introduced. Typically, a fluid is fed into the center of a spinneret during spinning of precursor fibers to prepare hollow fibers, and the fibers are stabilized and carbonized to prepare hollow carbon fibers. [U.S. Pat. Nos. 5,338,605 and 4,358,017]

However, this method is inefficient because it requires a high amount of energy consumption to use and collect the fluid (gas, liquid). The fed fluid increases the solidification speed of an extruded acrylonitrile copolymer spinning solution, which is predominantly used for carbon fiber precursor preparation. Thus, it is difficult to produce carbon fibers with a high degree of strength, and with a diameter appropriate for use as a structural reinforcement. Accordingly, the carbon fibers produced by this method, instead are in actuality used for heat insulation, and thus their use is limited.

The above information disclosed in this Background section is only for enhancement of understanding of the background of the invention and therefore it may contain information that does not form the prior art that is already known in this country to a person of ordinary skill in the art.

SUMMARY OF THE DISCLOSURE

An object of the present invention is to provide an improved method for preparing hollow carbon fibers which have a high degree of strength and rigidity, and are advantageous in the weight reduction of structural parts due to its low apparent specific gravity.

In one aspect, the present invention provides a method for preparing hollow carbon fibers. In particular, the method includes preparing a spinning solution of an acrylonitrile-based polymer having a viscosity ranging from about 2000 to 5000 poise at room temperature; spinning the prepared spinning solution using a spinneret designed for spinning hollow fibers; super-drawing and drawing spun fibers to prepare hollow precursor fibers; and stabilizing and carbonizing the hollow precursor fibers to prepare the hollow carbon fibers.

Other aspects and exemplary embodiments of the invention are discussed infra.

The inventive method has the following advantages over a conventional hollow carbon fiber preparation method.

1. The fibers have a 10 to 50% lower specific gravity than conventional hollow carbon fibers (solid). Thus, they provide improved weight reduction when used, together with a plastic resin, as a structural frame in vehicles, aircrafts, etc.

2. Unlike conventional hollow carbon fibers, the fibers prepared by the illustrative embodiment of the present invention can be used for producing a carbon fiber composite showing a very high flexural rigidity with respect to the weight.

3. The hollow carbon fibers prepared using the conventional method have a very large carbon fiber cross section. However, in the preventive preparation method of the illustrative embodiment of the present invention, it is possible to prepare carbon fibers having a required diameter.

4. In the conventional hollow carbon fiber preparation method, during a spinning process, a secondary fluid is used, thereby requiring expensive spinning facilities and a fluid collecting process. In the illustrative embodiment of the present invention, however, since conventional hollow spinneret (nozzle) is still valid, the production unit cost can be significantly reduced.

BRIEF DESCRIPTION OF THE DRAWINGS

The above and other features of the present invention will now be described in detail with reference to certain exemplary embodiments thereof illustrated the accompanying drawings which are given hereinbelow by way of illustration only, and thus are not limitative of the present invention, and wherein:

FIG. 1 is a schematic cross sectional view showing a spinneret used in the preparation method according to an illustrative embodiment of the present invention.

It should be understood that the appended drawings are not necessarily to scale, presenting a somewhat simplified representation of various preferred features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Hereinafter reference will now be made in detail to various embodiments of the present invention, examples of which are illustrated in the accompanying drawings and described below. While the invention will be described in conjunction with exemplary embodiments, it will be understood that the present description is not intended to limit the invention to those exemplary embodiments. On the contrary, the invention is intended to cover not only the exemplary embodiments, but also various alternatives, modifications, equivalents and other embodiments, which may be included within the spirit and scope of the invention as defined by the appended claims.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless specifically stated or obvious from context, as used herein, the term "about" is understood as within a range of normal tolerance in the art, for example within 2 standard deviations of the mean. "About" can be understood as within 2%, 1%, 0.5%, 0.1%, 0.05%, or 0.01% of the stated value. Unless otherwise clear from the context, all numerical values provided herein are modified by the term "about Hereinafter, the inventive preparation method of hollow carbon fibers will be described in more detail.

First, a spinning solution is prepared. In a case of solution spinning generally used in an acrylonitrile-based polymer, the viscosity of the solution extruded from a spinneret is lower than that of the melt extruded from the same spinneret. Also little die-swell occurs in an extrudate as compared to melt spinning. Thus, it is difficult to prepare hollow fibers by using the solution spinning. However, in the illustrative embodiment of the present invention, a solution having an acrylonitrile-based polymer dissolved in a solvent is used as a spinning solution, in which the polymer has a viscosity ranging from about 2000 to 5000 poise, preferably ranging from 3000 to 4000 poise at room temperature. The acrylonitrile-based polymer used in the present invention is a polymer obtained by polymerizing acrylonitrile monomers as a main component. In the acrylonitrile-based polymer, the acrylonitrile units are included in an amount of 90 wt % or more, preferably of 95 wt % or more, with respect to the total polymer weight. When the acrylonitrile units are included in an amount of less than 90 wt %, the crystal structures of a carbon fiber precursor and carbon fibers are not sufficiently developed. This may reduce the strength and the rigidity of the carbon fibers. Thus, it is preferable that the content of the units is at least 90 wt %. Also, the acrylonitrile-based polymer may be a copolymer obtained by copolymerizing the above mentioned monomers with other monomers. In this case, it is preferable that the content of the acrylonitrile units be at least 90 wt %. As a monomer capable of being copolymerized, one or more of either acrylic acid (AA), methacrylic acid (MA), itaconic acid (IA), methacrylate (MA), or acrylamide (AM) may be used.

The solvent used in the preparation of a spinning solution may be one or more of either dimethyl sulfoxide (DMSO), dimethylformamide (DMF), dimethylacetamide (DMAc), or nitric acid.

Next, the prepared spinning solution is spun. In the illustrative embodiment of the present invention, the prepared spinning solution is spun by using a spinneret designed for spinning hollow fibers. When the spinning solution is extruded from a spinneret, the spinneret shown in FIG. 1 is used so as to achieve smooth hollow formation and dimensional stability in a solidification bath. The spinneret applied in the present invention has a hollow outer diameter ranging from about 0.3 to 0.5 mm, a hollow inner diameter ranging from about 0.15 to 0.35 mm, and a spinneret interval ranging from about 0.04 to 0.06 mm.

Next, hollow precursor fibers are prepared by drawing the spun fibers. As-spun fibers obtained from the spinning have a large cross section, and are thus difficult to use as a structural reinforcement member. Accordingly, in the illustrative embodiment of the present invention, super-drawing and drawing steps are carried out to adjust the thickness of the hollow carbon fibers. The super-drawing and drawing steps may be carried out according to any conventional method known to those skilled in the art. In the illustrative embodiment of the present invention, it is possible to produce thin precursor fibers with an outer diameter of about 10 μm.

In the super-drawing, a crystalline polymer is drawn without an increase of crystal orientation. The super-drawing is achieved when a specific drawing speed is satisfied at a temperature equal to or greater than a glass transition temperature of a polymer. Through the super drawing process, acrylonitrile fibers produced from each spinneret are thinned through inhibition of the crystal orientation up to a required extent. Then, the fibers are drawn to achieve a required thickness, and required properties.

More specifically, as-spun fibers are super-drawn. Herein, the super drawing temperature is equal to or greater than a glass transition temperature of acrylonitrile, preferably ranges from about 100 to 180° C., and more preferably 150 to 170° C. The drawing speed is set so that the strain rate ranges from about 0.4 to 400 l/sec and preferably from 150 to 250 l/sec. When the drawing speed is too high, molecular orientation is quickly achieved, on the other hand, when the drawing speed is too low, the productivity is reduced. After a required range of fiber diameter is achieved through super drawing, a conventional drawing process is carried out.

Next the hollow carbon fibers are prepared by stabilizing and carbonizing the hollow precursor fibers. In the present invention, in the stabilizing step, the precursor fibers are heat-treated under an oxidizing atmosphere at a temperature ranging from about 200 to 350° C. and preferably from 250 to 330° C. The stabilizing time depends on the thickness of precursor fibers, and the component copolymerized with the acrylonitrile-based polymer. Homo-acrylonitrile precursor fibers (e.g., with a 10 μm of diameter) require a stabilizing time ranging from about 2 to 4 hours. More specifically, in the stabilizing step, the precursor fibers are stabilized by being exposed under an oxidizing atmosphere at a temperature ranging from 200 to 280° C. and preferably at a temperature of 250° C. for 1 to 3 hours, and then under an oxidizing atmosphere at a temperature ranging from 300 to 350° C. and preferably at a temperature of 320° C. for 20 to 50 minutes. In the hollow precursor fibers obtained after the stabilizing step, a heat/chemical stable ladder-shaped chemical structure is formed. Herein, when the stabilization temperature is less than 200° C., the stabilization may be not complete correctly, on the other hand, when the stabilization temperature is greater than 350° C., the reaction may be carried out too quickly, thereby reducing the mechanical strength of carbon fibers.

In the present invention, while carbonizing, the stabilized fibers are heat-treated under an inert atmosphere (e.g., argon, nitrogen) at a temperature ranging from 1000 to 1800° C. and preferably at a temperature ranging from 1000 to 1500° C. for about 1 to 25 minutes and preferably 5 to 10 minutes. Then, most components except for carbon are volatilized, and carbon fibers with a honeycomb structure are prepared. The prepared carbon fibers may be, as required, graphitized by being additionally heat-treated under an inert atmosphere (e.g., argon) at a temperature ranging from about 2000 to 2800° C. and preferably ranging from 2300 to 2800° C. for 10 to 30 minutes.

In the stabilization, the carbonization, and the graphitization, the temperature-rising speed is maintained at about 2 to 7° C./min, preferably at 3 to 5° C./min, and especially preferably at 5° C./min. The inside temperature of a heat treating furnace may be set at different temperatures for the start running point and the end running point of fibers so as to adjust the temperature-rising speed. In order to prevent the fibers from shrinking, the speed of the roller within the heat treating furnace is adjusted so that the tension can be maintained in a range from about 0.5 to 2 gram force/filament.

The present invention will be described in more detail with reference to following Examples, but is not limited thereto.

EXAMPLES

The following examples illustrate the invention and are not intended to limit the same.

Example 1

15 wt % of acrylonitrile polymer was dissolved in dimethyl sulfoxide (DMSO) so as to prepare a spinning solution having a viscosity of 3500 poise at room temperature. The spinneret (hollow outer diameter: 0.5 mm, hollow inner diameter: 0.15 mm, spinneret interval: 0.05 mm) shown in FIG. 1 was used in spinning. Through dry-jet wet-spinning having a 10 mm interval between a spinneret and a solidification bath, as-spun fibers were prepared. The as-spun fibers were super-drawn at 150° C. at a strain rate of 200 l/sec in such a manner that the outer diameter can be 40 μm. The super-drawn fibers were drawn 15 times at 170° C. to provide hollow precursor fibers. The hollow precursor fibers were heat-treated at 250° C. for 2 hours by raising the temperature at a temperature-rising speed of 5° C./min under dehumidifying air, and then heat-treated at 320° C. for 25 minutes. The stabilized fibers were carbonized at 1300° C. for 5 minutes by raising the temperature at a temperature-rising speed of 5° C./min under a nitrogen atmosphere so as to prepare hollow carbon fibers.

Example 2

Hollow carbon fibers were produced in the same manner as described in Example 1, except that a spinneret having a hollow outer diameter of 0.5 mm, a hollow inner diameter of 0.35 mm, and a spinneret interval of 0.05 mm was used.

Comparative Example 1

Carbon fibers were produced with solid precursor fibers having the same outer diameter as the precursor fibers produced in Example 1.

Comparative Example 2

The inside-filled precursor fibers obtained from Comparative Example 1 were heated at 250° C. for 2.5 hours, at 320° C. for 40 minutes by raising the temperature at a temperature-rising speed of 5° C./min under dehumidifying air. Then, the stabilized fibers were carbonized at 1300° C. for 5 minutes by raising the temperature at a temperature-rising speed of 5° C./min under a nitrogen atmosphere so as to produce inside-filled carbon fibers (Solid).

Comparative Example 3

By using a composite spinning (core-shell) device disclosed in International Patent Publication WO 2009/049174, formamide was spun in the core as disclosed in U.S. Pat. No. 4,385,017. As-spun fibers were stabilized and carbonized under the same condition as described in Example 1 so as to produce hollow carbon fibers.

Properties of carbon fibers obtained from Examples 1 and 2 and Comparative Examples 1 to 3 were measured and noted in Table 1 below.

TABLE 1

| | Example | | Comparative Example | | |
|---|---|---|---|---|---|
| index | 1 | 2 | 1 | 2 | 3 |
| tensile strength (Gpa) | 4.5 | 2.6 | 3.7 | 4.6 | 0.9 |
| tensile modulus (Gpa) | 235 | 146 | 219 | 241 | 96 |
| outer diameter (μm) | 7.6 | 7.8 | 7.7 | 7.5 | 47 |
| apparent specific gravity | 1.65 | 0.99 | 1.78 | 1.82 | 0.87 |
| crystal size (nm) | 1.8 | 1.7 | 1.1 | 1.8 | — |

Wherein the tensile strength, tensile modulus were measured in accordance with ASTM D4018. Additionally, in hollow carbon fibers, a cross section includes a hollow portion. Crystal size is calculated by substituting a FWHM (Full Width at Half Maximum) value of a peak at $2\theta \approx 43°$ in a equatorial-directional integral graph from an XRD (Wide angle) diffraction image of carbon fibers into Scherrer's equation.

As noted in Table 1, as compared to fibers from Comparative Example 2 as conventional carbon fibers (solid), fibers from Examples 1 and 2 showed a lower apparent specific gravities by 9.3% and 45.6%, respectively. In other words, the inventive hollow carbon fibers showed a lower specific gravity than conventional carbon fibers (solid). Thus, they are advantageous in view of weight reduction, and also are useful as reinforcements in their carbon fiber composite. This is because the reduction of a mechanical strength is not in proportion to an empty space size of carbon fibers used in the composite. In other words, in the stabilizing step in the production of carbon fibers, the route required for oxygen diffusion becomes short, which makes it possible to further easily develop a crystal structure.

Also, by comparing hollow carbon fibers from Example 1 to carbon fibers (solid) from Comparative Example 2 in view of mechanical strength, it was found that the fibers from Example 1 have the same properties as Comparative Example 2. Thus, it is possible to produce carbon fibers having a low specific gravity and a high degree of mechanical strength. Especially, since the stabilization time of Example 1 is 45 minutes less than that of Comparative Example 2, it can be found that the preventive method requires a lower cost and is more efficient than Comparative Example 2.

Furthermore, it was found that final carbon fibers from Comparative Example 1 have significantly lower mechanical properties than fibers from Example 1 or Comparative Example 2 because they have an insufficiently developed crystal structure due to incomplete stabilization. Also, carbon fibers obtained from Comparative Example 3 have a large outer diameter and low mechanical properties. Thus, it is difficult to use them as a reinforcement member of a composite.

The invention has been described in detail with reference to exemplary embodiments thereof. However, it will be appreciated by those skilled in the art that changes may be made in these embodiments without departing from the principles and spirit of the invention, the scope of which is defined in the appended claims and their equivalents.

What is claimed is:

1. A method for preparing hollow carbon fibers, the method comprising:

preparing a spinning solution of an acrylonitrile-based polymer having a viscosity ranging from 2000 to 5000 poise at room temperature;

spinning the prepared spinning solution using a device designed for spinning hollow fibers;

super-drawing and drawing spun fibers to prepare hollow precursor fibers; and stabilizing and carbonizing the hollow precursor fibers to prepare the hollow carbon fibers, wherein a temperature for the super drawing has a range from about 100 to 180° C., and a speed of the super drawing is set so that a strain rate range from about 150 to 250 1/sec.

2. The method as claimed in claim 1, wherein the polymer is an acrylonitrile-based polymer which comprises acrylonitrile units in an amount of 90 wt % or more with respect to the total polymer weight.

3. The method as claimed in claim 1, wherein stabilizing the hollow precursor fibers includes, heat treating the precursor fibers under an oxidizing atmosphere at a temperature ranging from 200 to 350° C.

4. The method as claimed in claim 1, wherein carbonizing the hollow precursor fibers includes, heat treating the precursor fibers under an inert atmosphere at a temperature ranging from 1000 to 1800° C.

5. The method as claimed in claim 1, further comprising graphitizing the carbonized fibers through heat-treatment under an inert atmosphere at a temperature ranging from 2000 to 2800° C.

6. The method as claimed in claim 1, wherein the device used for spinning is a spinneret and has a hollow outer diameter ranging from 0.3 to 0.5 mm, a hollow inner diameter ranging from 0.15 to 0.35 mm, and a spinneret interval ranging from 0.04 to 0.06 mm.

* * * * *